United States Patent [19]

Vall

[11] 4,231,308

[45] Nov. 4, 1980

[54] SAILING VESSEL SELF STEERER

[75] Inventor: Seymour Vall, Manhattan, N.Y.

[73] Assignee: Falcon Safety Products, Inc., Mountainside, N.J.

[21] Appl. No.: 9,126

[22] Filed: Feb. 5, 1979

[51] Int. Cl.[3] ..... B63H 25/04

[52] U.S. Cl. ..... 114/144 R; 114/144 C

[58] Field of Search ..... 114/144 R, 144 C, 39, 114/102, 91, 143, 204

[56] References Cited

U.S. PATENT DOCUMENTS

| | | | |
|---|---|---|---|
| 1,846,458 | 2/1932 | Robinson | 114/144 C |
| 2,653,563 | 9/1953 | Long | 114/39 |
| 3,438,349 | 4/1969 | Curtis et al. | 114/102 |
| 3,811,395 | 5/1974 | Decis | 114/144 R |

*Primary Examiner*—Sherman D. Basinger

*Attorney, Agent, or Firm*—George M. Gould

[57] ABSTRACT

A self steerer for use in sailing vessels is described. The device comprises a balance reel and associated control lines. The steerer balance reel is mounted on the tiller and uses both sail and rudder corrections simultaneously to keep the boat on a preselected course.

6 Claims, 9 Drawing Figures

SAILING VESSEL SELF STEERER

BACKGROUND OF THE INVENTION

There are two basic types of self-steering devices which are presently employed to control course automatically on sailing vessels. The first of these are electronic self steerers which are designed and constructed to follow a compass course regardless of the direction or velocity of the wind. This is accomplished by providing a small electric motor which is activated each time the vessel turns away from the desired compass course. The motor turns the rudder until the boat is once more headed in the desired direction.

While electric self steerers do achieve the desired goal of automatic course control, they do suffer from deficiencies as well. For example, electric self steerers obviously require a continuous and sufficient source of current which is not always readily available on a sailing vessel. Moreover, in the event that the wind veers to a point directly ahead of the vessel, the vessel will stop as it cannot sail any closer than a 35 degree angle to the source of the wind. If the vessel's sails are trimmed for sailing close to the wind (beating) and the wind veers so that its source is broadside to the boat, the vessel will be overtrimmed and in strong winds serious damage may result.

Another type of self-steerer known in the art employs "wind vanes" which are set to keep vessels on the same angle to the wind. The wind vane device is mounted on the stern of the vessels and is either linked to the tiller or it may have its own steering oar. In operation, the vessel is set on course and the leading edge of the wind vane is faced directly into the wind. If the vessel wanders the side of the wind vane is presented to the wind. The wind turns the vane, which then turns the tiller and rudder or its own steering oar, until the boat returns to its desired course. Problems which are associated with the use of wind vanes can be summarized as follows. Wind vanes are subjected to tremendous stress and thus require very heavy mountings on the stern of the vessel. The mounts tend to be unsightly and cumbersome. The vanes have to be large and strong enough to stand up to heavy winds. In strong winds the strain on these devices is tremendous. Steering oars frequently break and the control linkage is subjected to prolonged chafing thus producing a tendency to fail. Yet conversely the vanes have to be large and light enough to respond to light winds so they can still develop enough force to overcome the friction and inertia in the system.

DESCRIPTION OF THE INVENTION

The present invention relates to a wind activated self-steerer device for sailing vessels, which device is of novel design, construction and mode of operation. It is more compact and less costly than other self-steerer devices which have heretofore been available in the art. Power to operate the self-steerer is derived from the sail which provides the large and most sensitive power source even in light winds. At the same time the self-steerer is designed and constructed to be able to stand up to the heaviest winds.

The balance reel element of the instant self-steerer mounts on the tiller and is easily removable and portable. The device uses the sailing vessels, own rudder to steer the boat and thus utilizes the steering apparatus designed to do the job for the specific vessel. In addition, the self-steerer of the present invention utilizes the "natural" turning forces of the vessel to keep the boat on the desired course so that the amount of rudder movement needed is kept to a minimum.

In order to better understand the method of operation of the self-steerer of the invention it would be useful to briefly review the concepts underlying the steering of sailing vessels. It is understood of course that such discussion is for purpose of illustration only and is not intended to limit the scope of the instant invention in any manner.

Figure 1:
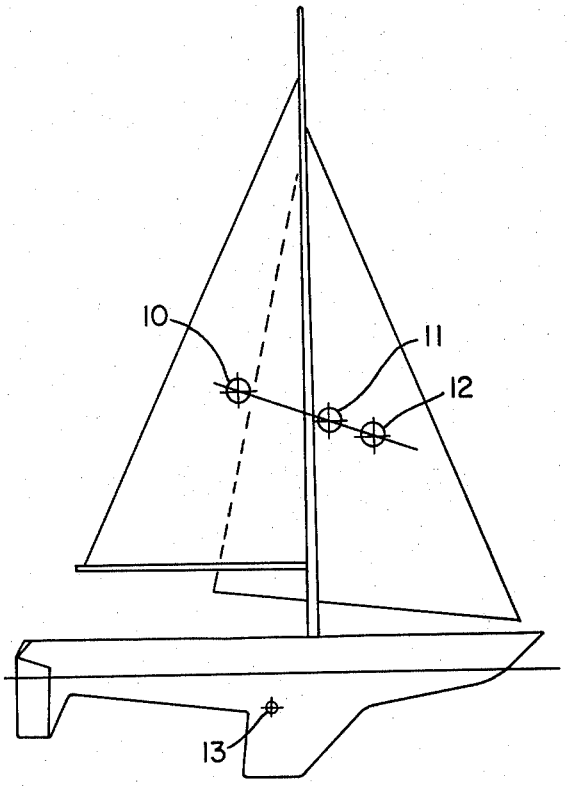
FIG. 1 is a schematic side view of the center of efforts and center of lateral resistance in a sailing vessel which are in balance and thus the boat stays on its course.

The keel of a sailing vessel presents lateral resistance to the water which prevents the vessel from sliding sideways. As seen in FIG. 1, the center of this lateral resistance (the CLR) B is actually a pivot point about which the vessel can turn. Each sail of the vessel has a center of effort (CE) which moves forward or aft depending upon the angle of the sail to the wind and upon the velocity of the wind.

The CE 10 of the main sail is usually located aft of the CLR while the CE of the jib sail 12 is usually located forward of the CLR. When the sails are adjusted so that their CE's are in the proper relation to the wind and the CLR, the boat will not turn upon its pivot point. In this condition, the sails of the boat are said to be in balance with the CE of the jib and main sails located at the aft portion of the jib sail as seen by the mark 11. The boat will continue to sail unguided until either the wind changes direction and/or the velocity of the wind changes.

Figure 2:
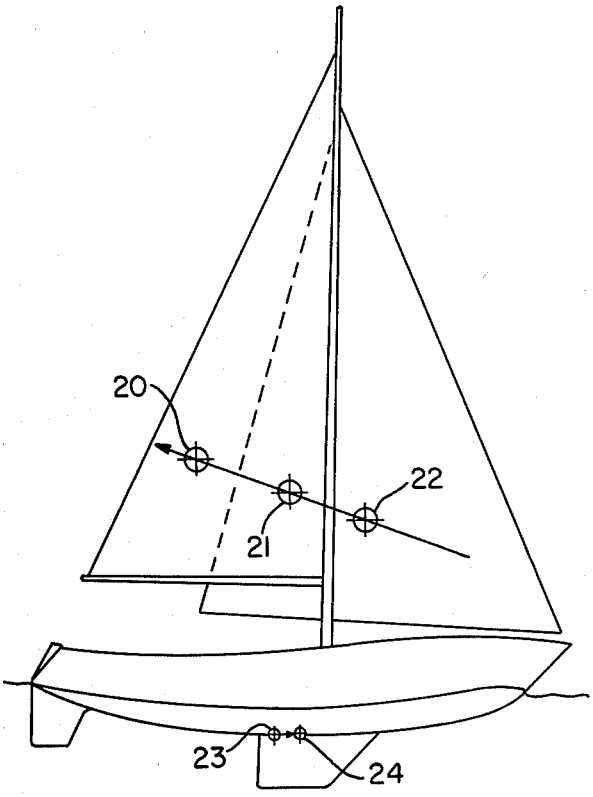
FIG. 2 is a schematic side view of the same sailing vessel where the center of effort of the sails moves aft.

If the wind should increase in velocity (even momentarily) the boat will increase its angle of heel (leaning attitude). Because of the shape of the hull, the CLR will move forward. Thus in FIG. 2 the original CLR 23 will move to position 24. At the same time, the increase in wind pressure will distort the shape of the sails and the CE of the jib 22 and the CE of the main 20 will move aft to yield a center of effort of jib and main at 21 which is now positioned at the fore portion of the main sail. The vessel is now in an unbalanced condition. Even though the rudder may be fixed in position; the bow of the vessel will be turned toward the direction of the source of the wind, and will continue to turn until the wind velocity decreases.

Figure 3:
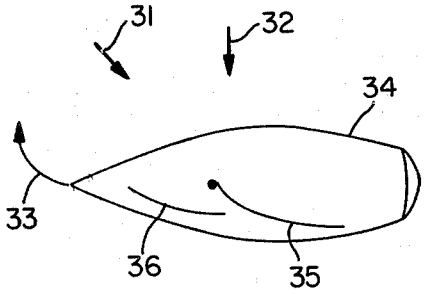
FIG. 3 is a schematic top view of a sailing vessel and the effect of an increase in wind velocity or a change in direction of such wind.

This situation is shown schematically in FIG. 3 where sailing vessel 34 exposed initially to wind from the direction of arrow 31 is then exposed to wind of an increased force and direction shown by arrow 32. The effect of this change on the main sail 35 and jib 36 is to cause turning of the bow in the direction of arrow 33 into the wind.

The crew of the vessel would normally counteract the tendency of the boat to turn up toward the source of the wind by turning the rudder and/or increasing the angle of the main sail to the wind. Increasing the angle of the main sail to the wind eases the pressure of the wind on the sail so that the CE tends to remain closer to its original position. In addition there is less heeling moment acting on the vessel so that the CLR tends to remain closer to its original position. Increasing the angle of the main sail to the wind decreases the amount of rudder correction required to keep the boat on course.

Figure 4:
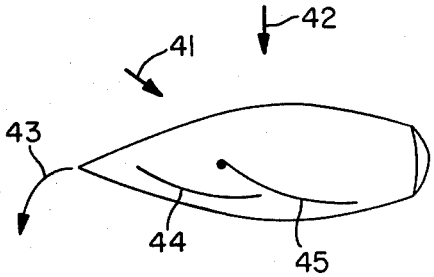
FIG. 4 is a schematic top view of a sailing vessel and the effect of a decrease in wind velocity or a change in direction of such wind in a reverse direction.

In the event the wind changes direction or its velocity decreases, the opposite effect will result. The CE of the sails will move forward, the angle of heel will decrease and the CLR will move aft. This situation is schematically shown in FIG. 4, where sailing vessel 46 initially exposed to wind from direction 42 is thereafter affected by a wind shift to direction 41. The effect of the wind change on jib 44 and main sail 45 causes the sailing vessel to turn in direction 42 or away from the source of the wind.

This condition may be corrected by decreasing the angle of the main sail to the wind and/or by turning the rudder. Again the use of the main sail to adjust the balance of the vessel requires the use of less rudder action to keep the vessel on course. When prior art methods of automatic course control are utilized, such as wind vanes or electronic steerers, the angle of the sails are set and fixed in position. These devices depend entirely on their ability to turn the rudder to keep the vessel on course. Since they must counteract the natural turning moment of the vessel with the rudder or steering oar only, a great deal of force is required.

It would be advantageous to utilize a self-steering device which automatically allows the main sail to adjust to a more efficient angle to the wind. The movement of the main sail in the course of this adjustment would provide turning power for the rudder. The self-steering device of the present invention will be seen to use both sail and rudder, correction simultaneously to maintain the vessel on a desired course.

Figure 5:
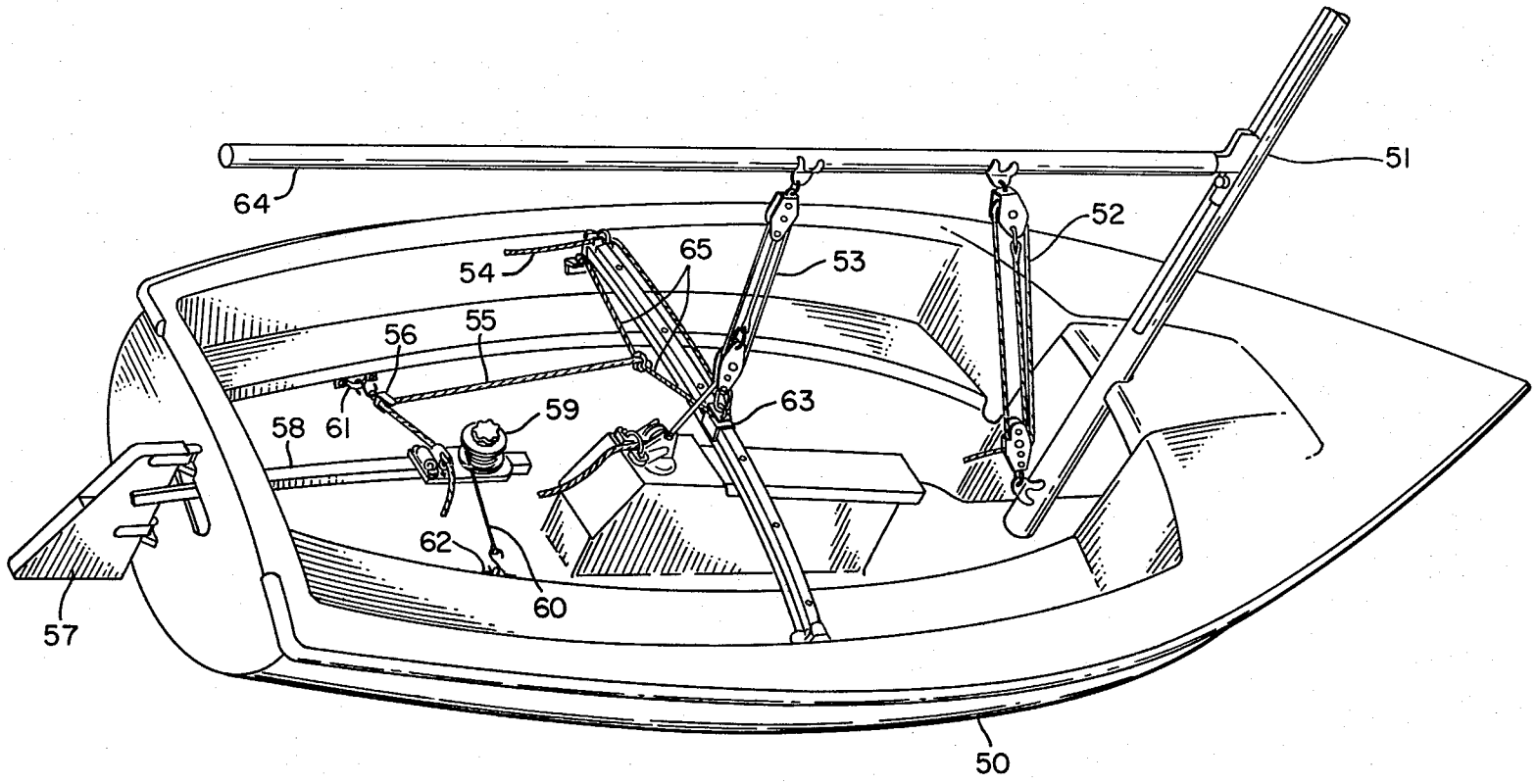
FIG. 5 is a diagrammatic top angle view of a sailing vessel indicating the location and construction of the elements and components which form the self-steerer of the instant invention and their operating interaction when installed in a sailing vessel.

The self-steering device of this invention is more clearly understood by reference to FIG. 5. In this Figure a diagrammatic view of the interior of a sailing vessel is provided showing the self-steering device of the invention installed in operating condition.

A key element of the self-steerer is a spring powered balance reel 59 which is mounted on a non-rusting metallic, i.e., stainless steel or aluminum, base onto the forward third of tiller 58 of sailing vessel 50. The balance reel spring is constructed of stainless steel or equivalent material and is of the constant force type. Thus each sixty degree turn of the balance reel will always develop the same increments of power, from 0 to 10 lbs. Additional turns will not increase the power of the reel. Suitable constant force spring powered balance reels can be constructed by employing spring powered reels, e.g., the model ML 1851, made available commercially by the Hunter Spring Division of Ametek, New Hyde Park, New York (note Bulletin SP-102, November 1978) utilizing stainless steel or plastic parts and stainless steel springs to adapt for marine use.

The balance reel is kept in its powered condition by two elements (1) a balance line 60 which is wound around the reel and in operation is hooked to a fixed point on the vessel such as eye strap 61; (2) a six toothed ratchet gear and moveable pawl located between the platform and the reel and which is linked to the arbor of the reel (the balance reel is described in specific detail below with respect to FIG. 6).

When the balance reel is attached to a fixed point, the spring motor may be wound by turning the knob clockwise increasing the tension of the balance reel line. The power may be released by disengaging the ratchet pawl or by disengaging the balance reel line from its fixed points.

Figure 6:
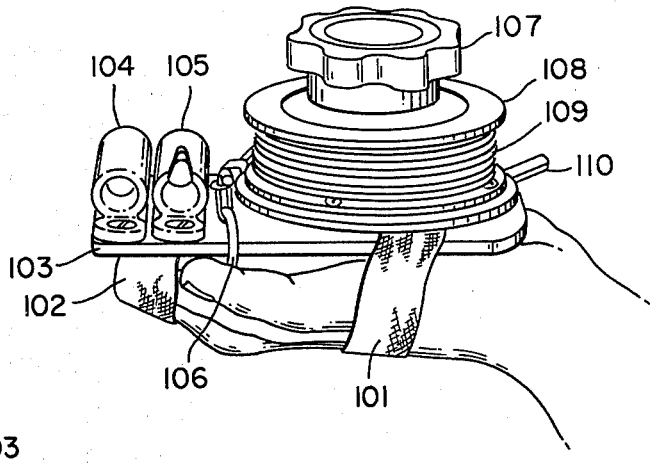
FIG. 6 is a side diagrammatic view of the balance reel element and associated components of the self-steerer of the instant invention.
Figure 9:
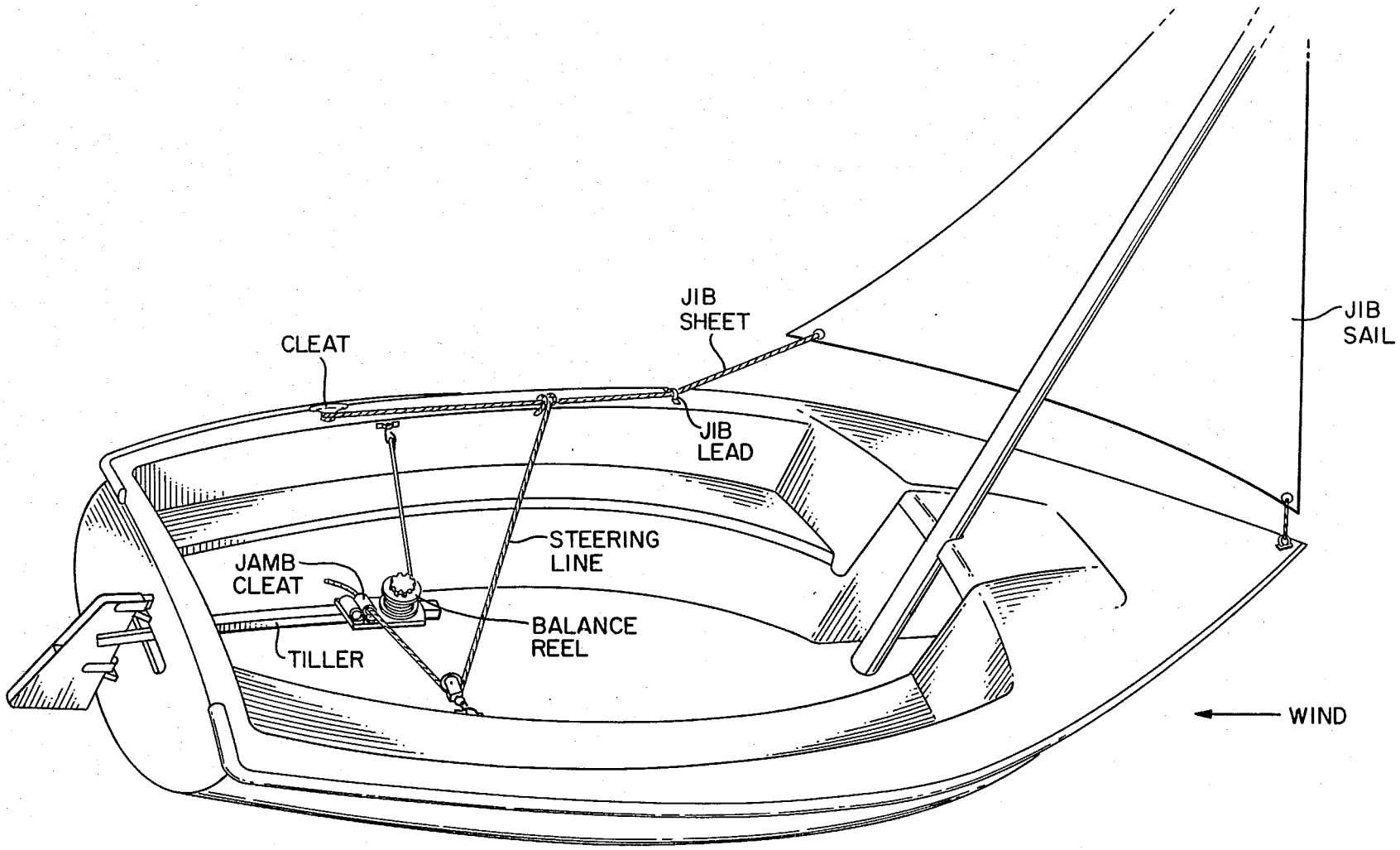
FIG. 9 is a diagrammatic top angle view of a sailing vessel showing the location and construction of the elements and components which form the self-steerer of the instant invention in the embodiment where there is no traveller and the steering line is attached to the jib sheet.

In effecting course control, the device utilizes a steering line 55 which at one operative end is connected to the balance reel assembly by jamb cleats hereafter described in FIG. 6, and at the other end is attached to the traveller control line 54. The attachment of the steering line to the traveller control line is conveniently carried out by means of a knot such as a rolling hitch or clove hitch. In the event a traveller is not available on the sailing vessel, the steering line may be attached to a point on the mainsheet 53, between the mainsheet cleat and the main sail boom 64 or, as shown in FIG. 9, to the jib sheet between the jib sail and jib sheet cleat.

During operation the course is selected and the sails are trimmed and balanced responsive to the general conditions prevailing. The steering line is led toward the tiller along the windward side of the boat. The steering line is passed through a turning block 56 and then through the proper jamb cleat on the balance reel assembly. The vessel is held on course while tension is placed on the steering line until a bend is created in the traveller control line. The steering line is then cleated to the said jamb cleat.

While still maintaining the vessel on course, the balance reel line 60 is attached to an eye strap on the leeward side of the boat, i.e., such as eye strap 61. The balance reel is then turned until all slack is just taken up. The reel is then turned on additional 120 to 180 degrees (two or three clicks of the ratchet). This will usually provide enough power in the spring motor to balance the tension on the steering line. When properly adjusted, the tiller may be released and it will stay in its proper sailing attitude until the wind changes its velocity and/or direction.

Should the wind increase in velocity (wind changes direction and velocity constantly) the increase pressure of the wind will push the sail to a greater angle to the wind. The amount of increase in sail-wind angle is determined and limited by the amount of bend 65 created in the traveller control line 54 by the tension of the steering line 55.

The traveller car 63 is connected to the main sail boom 64 by the main sheet 53. Additionally, sheet 52 serves to connect main sail boom 64 to main mast 51. When the traveller control line is bent, the traveller car is moved toward the source of the wind. An increase in wind velocity straightens out this bend, giving the sail 52 room to move away from the source of the wind. At the same time as the bend is being straightened the steering line 55 is being pulled toward the traveller 63 turning the tiller 58 in the direction required to keep the boat on course. The final result is that some sail adjustment is automatically made which tends to keep the CLR and CE in proper relation to each other. A small amount of tiller correction is added to keep the vessel on course. When the wind pressure on the sails returns to normal, the boat assumes its proper heeling attitude and the spring powdered reel 59 winds up on the balance line 60, returning the tiller 58 to its proper sailing position. Simultaneously, the bend in the traveller control line is recreated.

If the wind velocity decreases, the balance reel will react to the decrease in pressure on the sail and steering line and move the tiller to make the proper correction for the course. The tiller movement will increase the bend in the traveller control line and move the sail toward the source of the wind, decreasing its angle to the wind. The result is the sail and rudder corrections required to keep the vessel on course are made automatically.

The corrections obtained by use of the device of the instant invention are continuous and instantaneous. There is little discernable lag between wind change and sail trim and rudder correction. Since the sail is linked directly to the tiller, tiller and rudder changes occur at the same time as sail position is corrected. Changes in wind direction have a similar effect as changes in wind velocity.

It is within the skill of the art to adapt the self-steering device to a wide range of wind and have conditions by increasing or decreasing the traveller control line bend and the spring power in the balance reel in accordance with the discussion set forth above.

A side diagrammatic view of the balance reel assembly is shown in FIG. 6. This assembly may be mounted to the vessel's tiller utilizing straps 101 and 102. The assembly is strapped approximately ⅓ the distance of the tiller length aft from the forward end. Platform 103 supports two jamb cleats 104 and 105 which are mounted forward when the assembly is attached to the tiller. Balance reel 108 contains balance line 109 which is wound around the reel portion. As seen in FIG. 6 the base of the reel has a larger diameter than the top of the reel to prevent the line from dropping off during use. The reel is controlled by turning balance knob 107 which is mounted on the top of the reel. Pawl 110 is attached to the arbor of the reel (now shown). An S-hook 106 is provided at the lead end of the balance line to allow for ready coupling to the eye strap on the vessel side.

Figure 7:
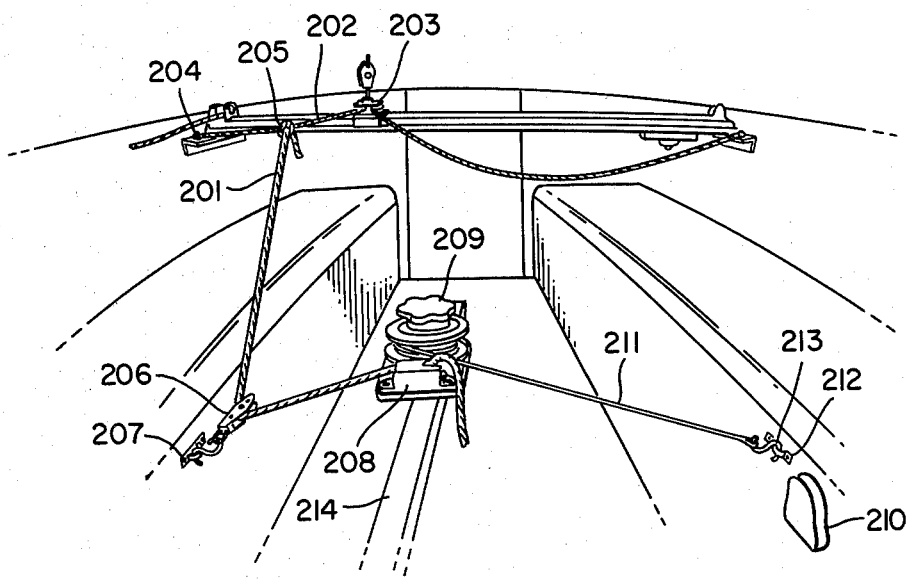
FIG. 7 is a diagrammatic view of the interior portion of a sailing vessel looking forward from the stern toward the bow showing the self-steerer balance reel elements and associated lines in operating position.

In FIG. 7 a diagrammatic front looking view from the stern of a sailing vessel is shown. The steering line 201 is seen tied to the traveller control line 202 between the traveller car 203 and the windward fixed end 204 of the traveller control line. The knot 205, either a clove hitch or a rolling hitch, should be very snug and should not readily slide along the traveller control line. The steering line block 206 is attached to the windward eyestrap 207 and the steering line passes through the said steering line block and through jamb cleat 208 on the balance reel assembly 209. The steering line is pulled through the jamb cleat to create the bend in the windward portion of the traveller control line and is then engaged in clam cleat 210 on the leeward side to set up the self-steerer operation and then is subsequently released.

The balance line 211 is attached to the leeward eye strap 212 by means of S-hook 213. The boat is kept on course by steering the boat from the leeward side of the tiller 214 at this time. The tension on the balance reel is released by pushing on the trigger of the pawl (note FIG. 6). Then while the tiller is held steady on course the balance knob is turned clockwise to take up slack on the balance line. The reel is turned one or two clicks more to put tension on the balance line. The steering line is then engaged in the jamb cleat of the steerer and disengaged from the leeward clam cleat to place the self-steerer in operating condition.

Figure 8:
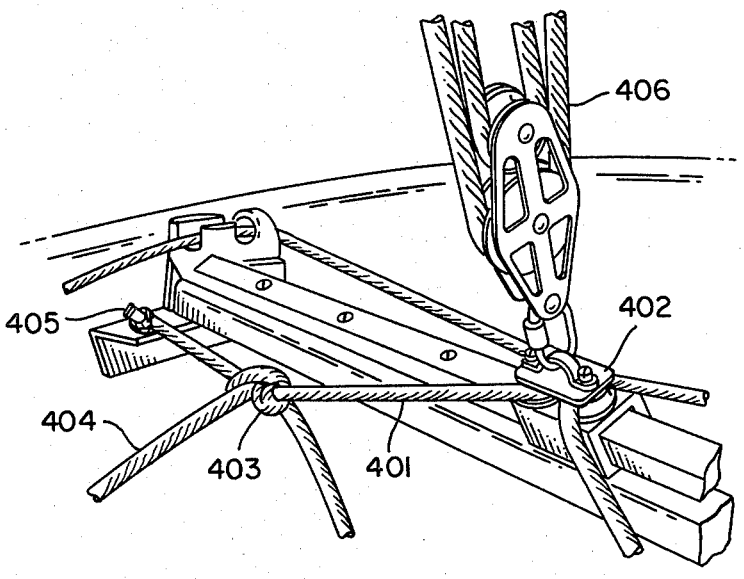
FIG. 8 is a diagrammatic view of the interior portion of a sailing vessel looking towards the windward side showing the traveller, traveller control lines and bend in operating position.

FIG. 8 shows a detailed diagrammatic view of the formation of the bend in the traveller control line. The traveller control line 401 is seen running between traveller car 402, which supports main sheet 406, and fixed end 405. The steering line 404 is attached to the traveller control line by means of knot 403. Tension on the steering line causes a bend to be created in the traveller control line as hereinbefore described.

FIG. 9 shows a diagrammatic front look view from the stern of a sailing vessel showing the embodiment where no traveller is present and the steering line is connected to the jib sheet between the jib sail and the jib cleat.

I claim:

1. A self-steering system for maintaining a preselected course in a sailing vessel which system comprises in combination:

(A) balance reel assembly means comprising a balance reel; a balance line wound around said balance reel and having one end attached to the leeward side of said sailing vessel and one end attached to said balance reel, jamb cleat means and base means for supporting the aforesaid balance reel assembly means components, said base means being detachedly attached to the tiller of said sailing vessel;

(B) steering line means having two ends, one end being attached to said jamb cleat means of said balance reel assembly means; and (C) traveller control line means mounted transversly from the leeward to the windward side of said vessel, said traveller control line means being operatively connected intermediate to said sides to mainsheet means, said second end of said steering line means being connected to said traveller control line means at a point between said mainsheet means and said windward side of said vessel, whereby when tension is placed on said balance line, steering line means and traveller control line means by action of said balance reel a bend is formed in said traveller control line means in the vicinity of the point where said steering line means is connected to said traveller control line means, and whereby further changes in wind velocity or direction are directly translated by corresponding changes in the extent of the bend into simultaneous sail and rudder adjustments to return the vessel to a desired preselected course.

2. The self-steering system of claim 1 wherein said balance reel is of the constant force type.

3. The self steering system of claim 2 wherein said tension is introduced when the balance reel is turned an additional 120 to 150 degrees beyond the point where any slack in the system is taken up.

4. The self-steering system of claim 1 wherein said mainsheet means comprises a traveller car and mainsheet.

5. The self-steering system of claim 1 wherein said base means comprises a non-rusting metallic base having straps for mounting said balance reel assembly means on said tiller.

6. A self-steering system for maintaining a preselected course in a sailing vessel which system comprises in combination:

(A) balance reel assembly means comprising a balance reel; a balance line wound around said balance reel and having one end attached to the leeward side of said sailing vessel and one end attached to said balance reel, jamb cleat means and base means for supporting the aforesiad balance reel assembly means components, said base means being detachedly attached to the tiller of said sailing vessel;

(B) steering line means having two ends, one end being attached to said jamb cleat means of said balance reel assembly means; and (C) jib sheet mounted forward from jib cleat means to the jib sail, said second end of said steering line means being connected to said jib sheet at a point between said jib cleat means and said jib sail whereby when tension is placed on said balance line and steering line means by action of said balance reel a bend is formed in said jib sheet in the vicinity of the point where said steering line means is connected to said jib sheet, and whereby further changes in wind velocity or direction are directly translated by corresponding changes in the extent of the bend into simultaneous sail and rudder adjustments to return the vessel to a desired preselected course.

* * * * *